US007398756B2

(12) United States Patent
Ruetz

(10) Patent No.: US 7,398,756 B2
(45) Date of Patent: Jul. 15, 2008

(54) BOTTOM PLATE FOR A CRANKCASE

(75) Inventor: Georg Ruetz, Immenstaad (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 11/444,070

(22) Filed: May 31, 2006

(65) Prior Publication Data

US 2006/0213476 A1 Sep. 28, 2006

Related U.S. Application Data

(63) Continuation-in-part of application No. PCT/EP2004/013698, filed on Dec. 2, 2004.

(30) Foreign Application Priority Data

Dec. 6, 2003 (DE) ..... 103 57 175

(51) Int. Cl.
*F02B 77/00* (2006.01)
*F02F 7/00* (2006.01)

(52) U.S. Cl. ..... 123/200; 123/195 C

(58) Field of Classification Search ..... 123/200, 123/196 CP, 41.86, 195 C, 196 R, 41.33, 123/196 AB, 195 R; 92/261; 184/106
See application file for complete search history.

(56) References Cited

U.S. PATENT DOCUMENTS 2,782,008 A * 2/1957 Caughill ..... 165/67
3,991,735 A * 11/1976 Horstmann ..... 123/195 C
4,077,739 A * 3/1978 Heilenbach ..... 415/121.2
5,103,782 A * 4/1992 Matsui ..... 123/195 C
5,271,142 A * 12/1993 Moore et al. ..... 29/469.5
5,601,060 A * 2/1997 Smietanski et al. ..... 123/195 C
5,927,396 A * 7/1999 Damsohn et al. ..... 165/167
6,177,173 B1 * 1/2001 Nelson ..... 428/137
6,182,749 B1 * 2/2001 Brost et al. ..... 165/297
6,513,326 B1 * 2/2003 Maceda et al. ..... 60/517
7,066,133 B2 * 6/2006 Groddeck et al. ..... 123/195 C
7,201,216 B2 * 4/2007 Geiger et al. ..... 165/153
7,225,785 B2 * 6/2007 Groddeck et al. ..... 123/195 C
2003/0000495 A1 * 1/2003 Groddeck et al. ..... 123/195 C
2003/0140887 A1 * 7/2003 Rosendahl et al. ..... 123/195 C
2004/0008862 A1 * 1/2004 Garner ..... 381/423
2004/0177826 A1 * 9/2004 Duwel ..... 123/196 R
2005/0011482 A1 * 1/2005 Groddeck et al. ..... 123/195 C
2005/0194124 A1 * 9/2005 Geiger et al. ..... 165/179
2005/0244304 A1 * 11/2005 Tonkovich et al. ..... 422/100
2005/0257766 A1 * 11/2005 Rau et al. ..... 123/195 C
2006/0021343 A1 * 2/2006 Maceda et al. ..... 60/520
2006/0024550 A1 * 2/2006 Rock et al. ..... 429/34
2006/0070598 A1 * 4/2006 Marks et al. ..... 123/195 C
2006/0096362 A1 * 5/2006 Vialard ..... 73/119 R
2006/0102139 A1 * 5/2006 Fernandez Garcia ..... 123/200
2006/0108397 A1 * 5/2006 Tonkovich et al. ..... 228/101
2006/0130801 A1 * 6/2006 Suzuki et al. ..... 123/196 R
2006/0169240 A1 * 8/2006 Hanner et al. ..... 123/195 C
2006/0201470 A1 * 9/2006 Vichinsky ..... 123/184.61
2006/0228265 A1 * 10/2006 Peng et al. ..... 422/102

* cited by examiner

*Primary Examiner*—Stephen K. Cronin
*Assistant Examiner*—Hyder Ali
(74) *Attorney, Agent, or Firm*—Klaus J. Bach

(57) ABSTRACT

In a bottom plate for closing a crankcase of an internal combustion engine wherein the bottom plate includes openings and channels for collecting and conducting fluids, the bottom plate consists of a number of individual plates which are joined together after the channels and openings have been cut into the individual plates by laser beam cutting or water beam cutting.

6 Claims, 5 Drawing Sheets

BOTTOM PLATE FOR A CRANKCASE

This is a Continuation-In-Part Application of International Application PCT/EP2004/013698 filed 2 Dec. 2004 and claiming the priority of German Application 103 57 175.2 filed Dec. 6, 2003.

BACKGROUND OF THE INVENTION

The invention relates to a bottom plate for a crankcase of an internal combustion engine with passages for lubricant and coolant integrally formed into the bottom plate and to a method of making such a bottom plate.

DE 198 55 562 C1 discloses a crankcase with chambers which serve as lubricant storage spaces.

DE 100 33 416 C1 discloses a bottom plate for closing a crankcase. The bottom plate extends over the whole base area of the crankcase. On the bottom plate, the pumps, heat exchangers and filters are arranged. Channels for conducting media such as the lubricant and the coolant are integrated into the bottom plate. At each end, the power output end and the opposite end, the bottom plate is provided with a recess for collecting lubricant. In the description, such a recess will be called suction location. The lubricant dripping down from the crankshaft area is directed toward these suction locations by fluid guide structures. The lubricant is then pumped by a suction pump from the suction locations via passages in the bottom plate to the various chambers of the crank case.

In practice, the bottom plate is an aluminum casting. The packaging density and the free channel length of the bottom plate is determined largely by the smallest possible core height and the required minimum wall thickness. Additional functions such as preheating can therefore be integrated into the bottom plate and by a new design with a correspondingly larger volume.

It is therefore the object of the present invention to provide a bottom plate which offers a greater variety of choices.

SUMMARY OF THE INVENTION

In a bottom plate for closing a crankcase of an internal combustion engine wherein the bottom plate includes openings and channels for collecting and conducting fluids, the bottom plate consists of a number of individual plates which are joined together after the channels and openings have been cut into the individual plates by laser beam cutting or water beam cutting.

The bottom plate is manufactured by the jointure of the individual plates via cementing or soldering under compression. The channels in the individual plates are cut into the plates by laser beams or water beams.

With the invention, the packing density is increased that is more devices and structures can be accommodated by such a bottom plate. For the height of the channels, the lengths of the channels and the complexity of the channel arrangement, the manufacturing limitations are minimized. A later change of the position of for example a pump will not require a new design of the whole bottom plate. The higher packing density also provides for the possibility of installing additional functions such as preheating areas, drainage and additional medium guide structures.

Below a preferred embodiment of the invention will be described on the basis of the accompanying drawings.

DESCRIPTION OF A PREFERRED EMBODIMENT

Figure 1:
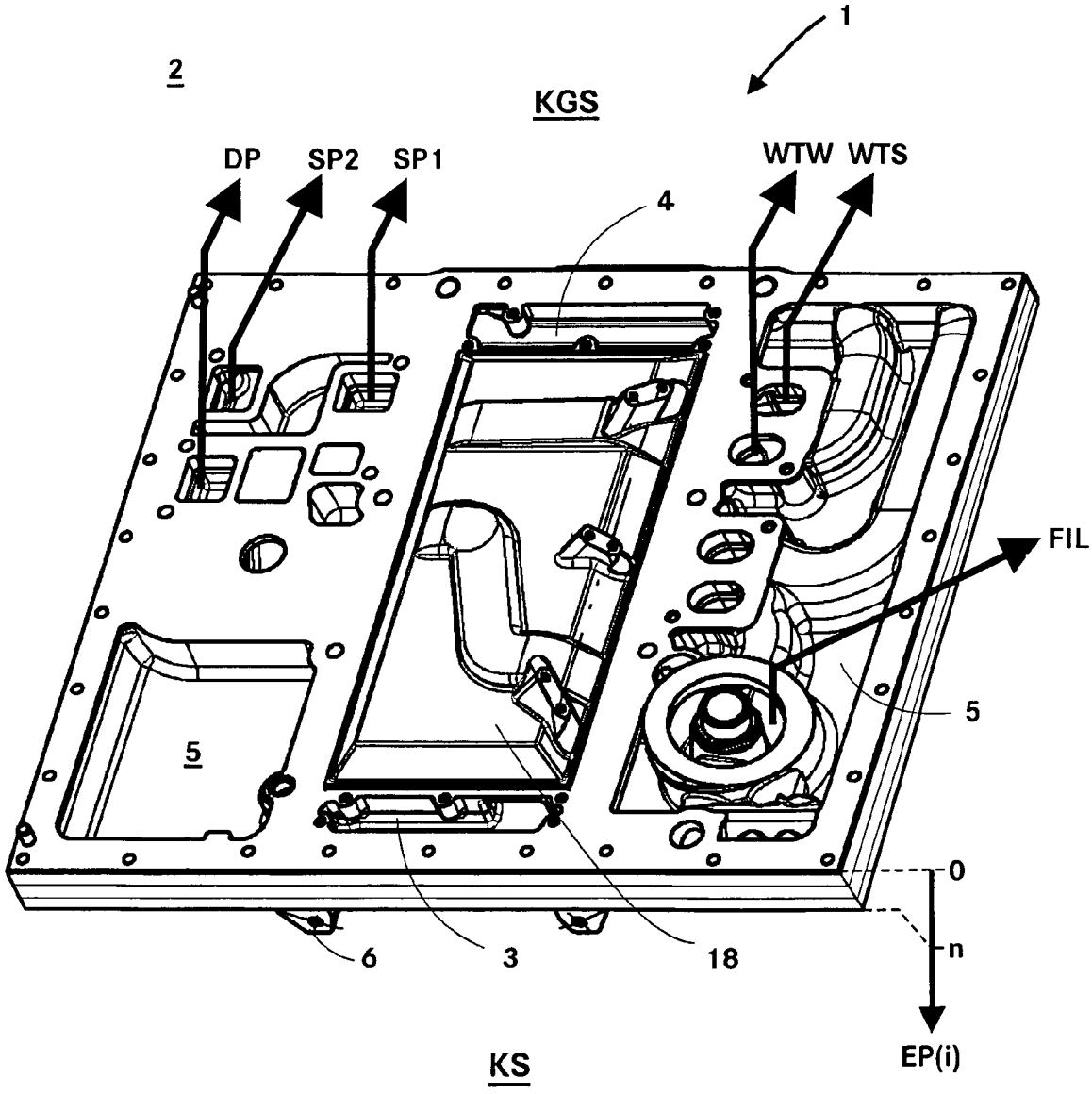
FIG. 1 is a perspective view of the bottom plate according to the invention.

FIG. 1 shows a bottom plate 1 in a perspective view. Such a bottom plate is basically known from DE 100 33 416 C1. It represents however not only the state of the art on which the present invention is based but indicates also that the bottom plate is composed of various individual plates—according to the present invention. The bottom plate 1 closes a crankcase 2 of an internal combustion engine at the bottom thereof. The bottom plate 1 extends over the whole bottom area of the crank-case 2. The pumps, the filter and the heat exchanger are arranged on the bottom plate 1. In FIG. 1, those components are not shown for clarity reasons. On the power input end KS, a first suction location 3 is provided in the bottom plate 1. On the opposite end KGS, a second suction location 4 is provided. The lubricant dripping from the crankcase space is supplied by a fluid guide structure 18 to the first suction location 3 and to the second suction location 4. The suction locations form collections chambers. The lubricant from the first suction location 3 is pumped by a first suction pump indicated by an arrow SP1 via a channel extending through the bottom plate 1. In FIG. 1, the pumped volume flows are indicated by heavy lines. The lubricant of the second suction location 4 is pumped by a second suction pump SP2 whose volume flow is indicated in FIG. 1 by a heavy line connected to the arrow SP2.

The suction pumps SP1 and SP2 pump the lubricant to the lubricant storage chambers 5 of the crankcase 2. The line with the arrows marked by the reference sign WTS indicates a lubricant-volume flow to the heat exchanger. The reference sign FIL indicates a lubricant volume flow to an oil filter. At the power input end KS, the bottom plate 1 is provided with two flange faces 6 by which for example a flywheel housing or a clutch housing can be connected with the crankcase 2 and the bottom plate 1.

The bottom plate 1 consists of several individual plates of the same circumference. In FIG. 1, these sandwiched individual plates are indicated by the reference numeral EP(i). The number in parenthesis indicates the distance of the individual plate from the reference plain zero. The individual plate EP(0) designates that individual plate which directly abuts the crankcase 2. The individual plate EP(n) designates the individual plate delimits the bottom plate toward the ambient. The individual plates EP(i) may have all the same thickness or they may have different thicknesses. A thickness of about 2 to 5 mm has been found appropriate. The channels in the individual plates are manufactured by laser cutting or water beam cutting. Subsequently, the individual plates are joined by a cement or solder connection so as to form a compact media flow management plate.

Figure 2:
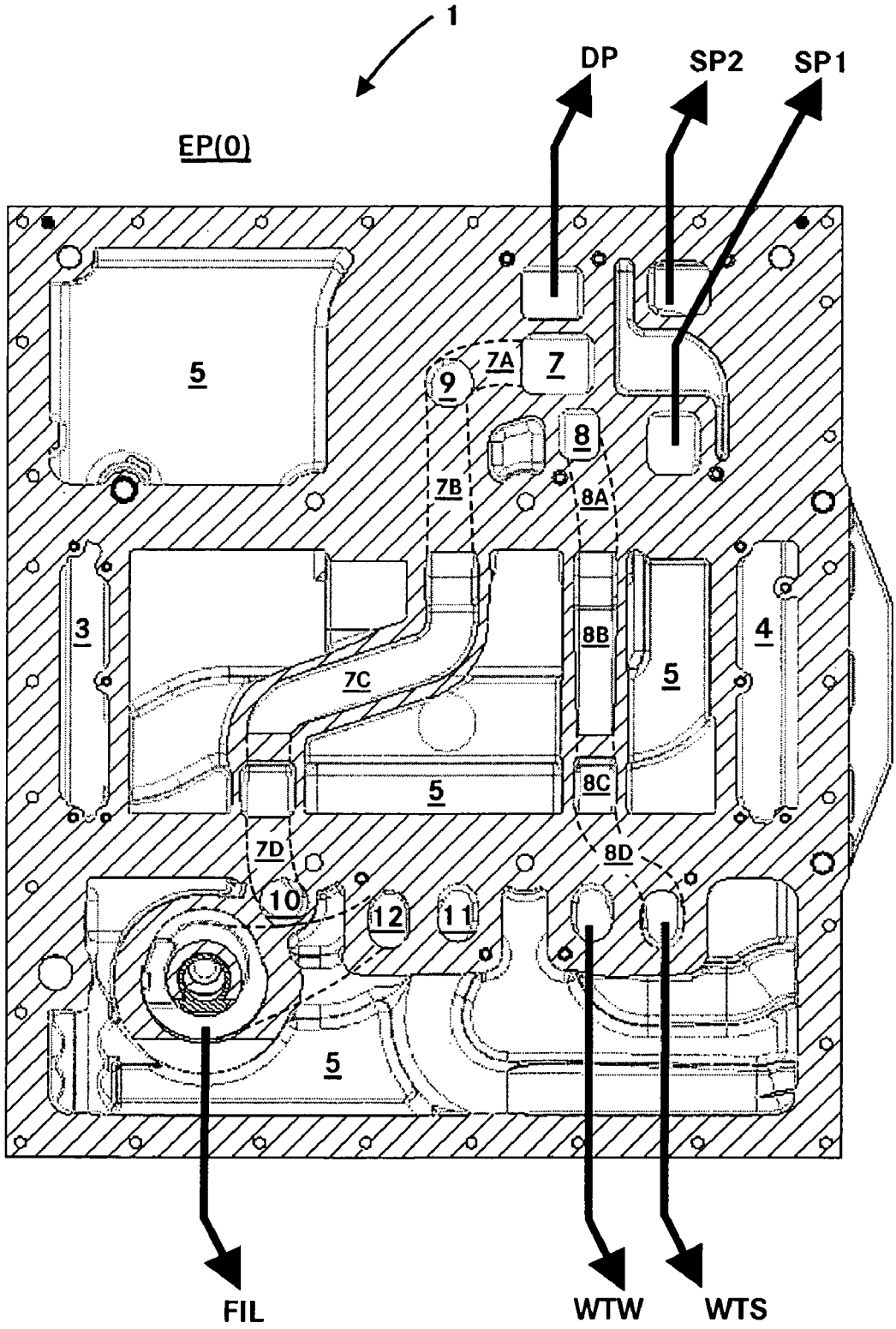
FIG. 2 shows an individual plate in a top view.

In FIG. 2, an individual plate EP(0) is shown in a top view. It abuts directly the crankcase 2 of the internal combustion engine. The lubricant volume of the first suction location 4 is pumped by the second suction pump SP2. The total volume flow of the two suction pumps SP1 and SP2 is then conducted via a pressure channel 7 to a first outlet 9 and a second outlet 10. In FIG. 2, a first section 7A extends from the pressure channel 7 to the first outlet 9. Sections 7B, 7C and 7D extend from the first outlet 9 to the second outlet 10. The two sections 7A, 7B and 7D are disposed outside the cross-section plane and are therefore shown hatched. The lubricant volume pumped by the pressure pump DP is conducted through a pressure channel 8. The pressure channel is, by way of sections 8A, 8B, 8C and 8D in communication with an opening via which the lubricant is supplied to the heat exchanger WTS. The sections 8A and 8D are disposed outside the cross-sectional plane and are therefore shown by dashed lines. After the lubricant has passed the heat exchanger WTS, it is returned to the bottom plate 1 via an inlet 12. From the inlet 12, the lubricant is directed via a respective channel to an oil filter. In FIG. 2, the volume flow through the filter is indicated by the sign FIL. The reference numeral 11 indicates a water inlet into the bottom plate 1 after passing through the heat exchanger WTW. The lubricant storage chambers are indicated by the reference numerals 5. They are in communication with the respective chambers in the crankcase 2 of the internal combustion engine.

Figure 3:
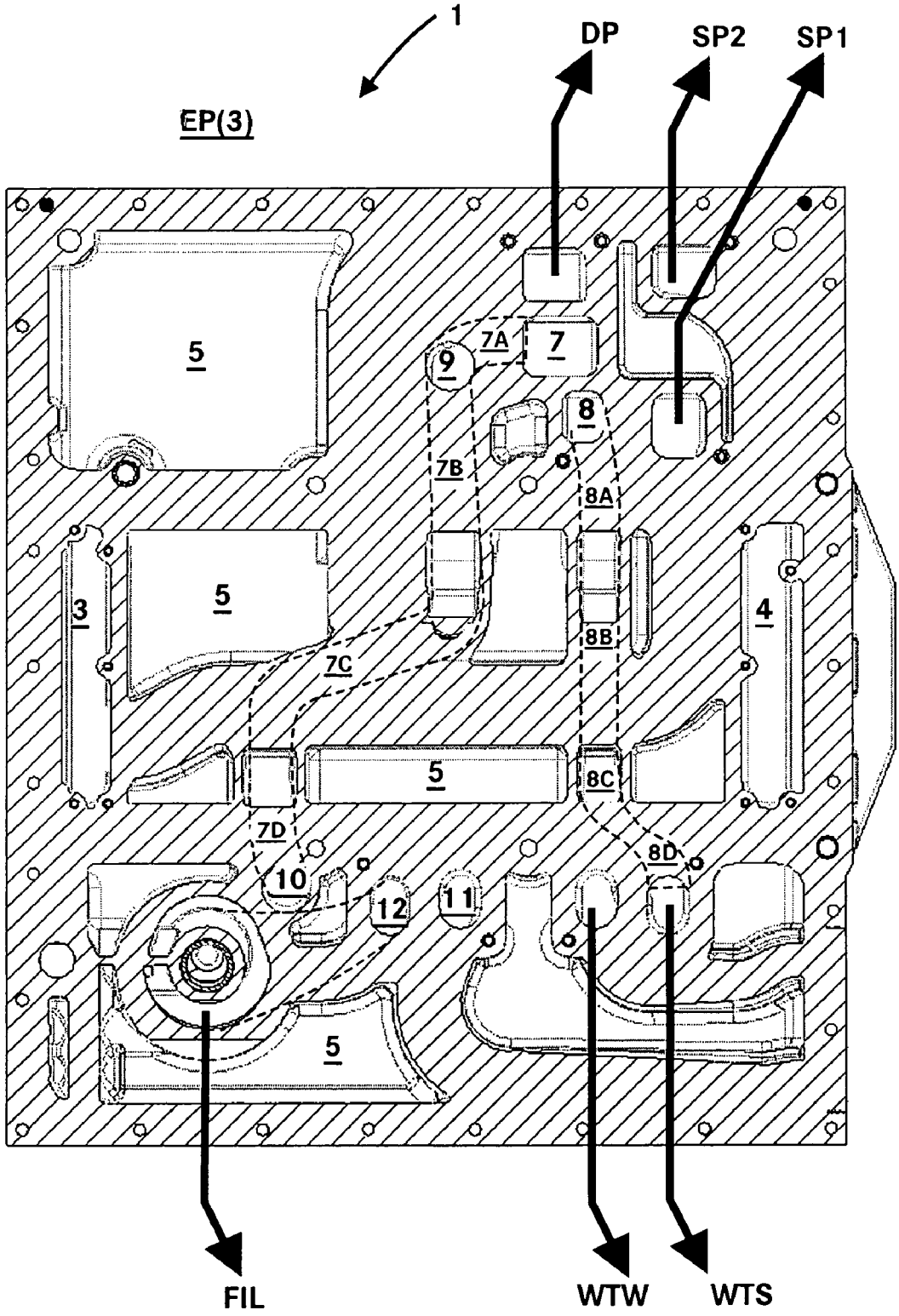
FIG. 3 shows another of the individual plates.

FIG. 3 shows an individual plate EP(3). Different from FIG. 2 in this case the section 7C of the pressure channel 7 and the section 8B of the pressure channel 8 are not disposed in the section plane. For the functionality, the description for FIG. 2 applies.

Figure 4:
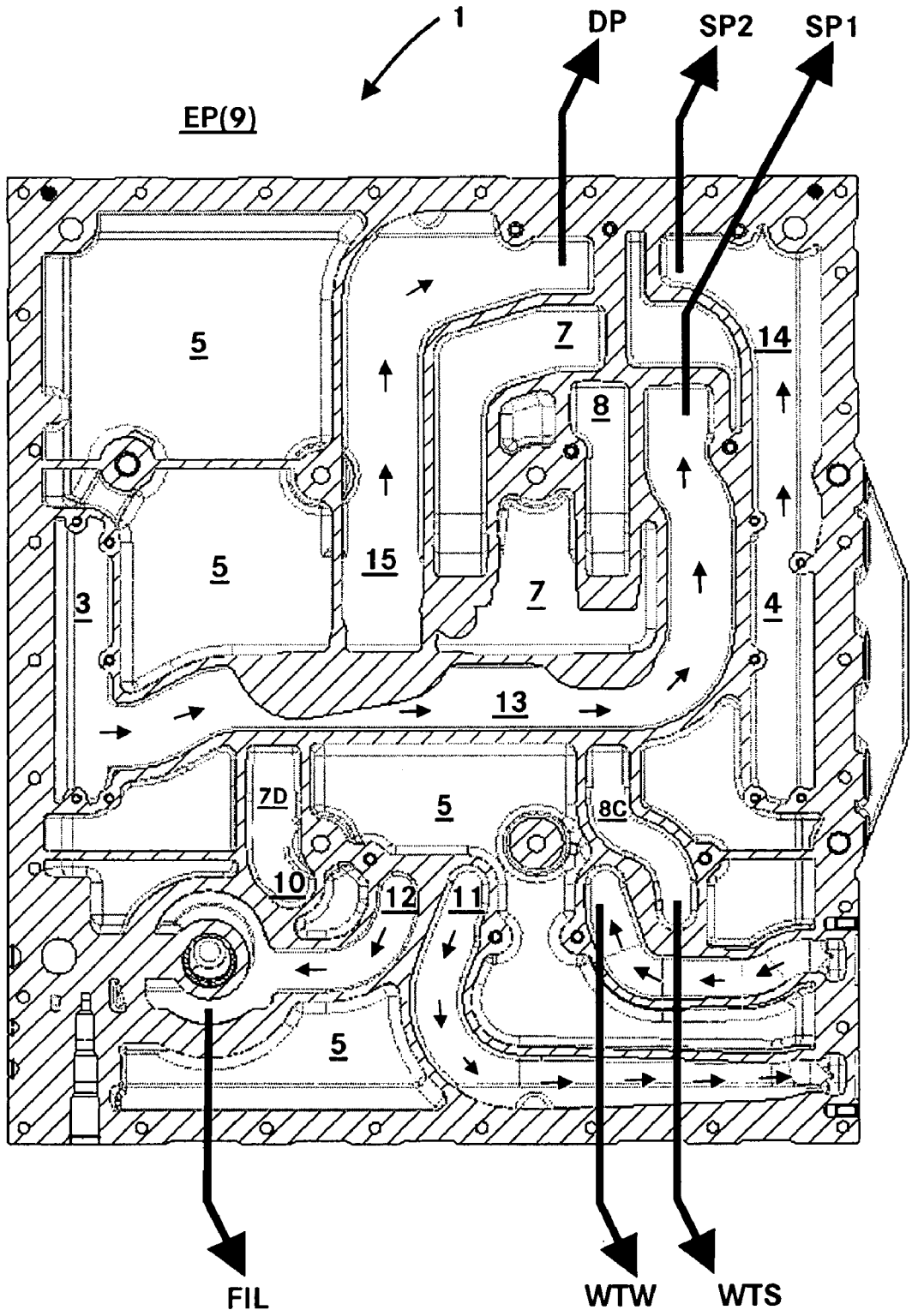
FIG. 4 shows still another of the individual plates.

FIG. 4 shows an individual plate EP(9). In the cross-section shown a channel 13 is shown to extend from the first suction location 3 to the first suction pump SP1. The reference numeral 14 indicates a channel which extends from the second suction location 4 to the second suction pump SP2. In this cross-section also the channels for conducting water to, and from, the heat exchanger WTW. After the water has passed the heat exchanger WTW, it is returned to the inlet 11 in the bottom plate 1. From there, it is distributed via a corresponding channel. In this individual plate 1, the connecting channel for conducting the lubricant from the inlet 12 to the oil filter FIL is shown. The reference numeral 15 indicates the channel leading to the pressure pump DP.

Figure 5:
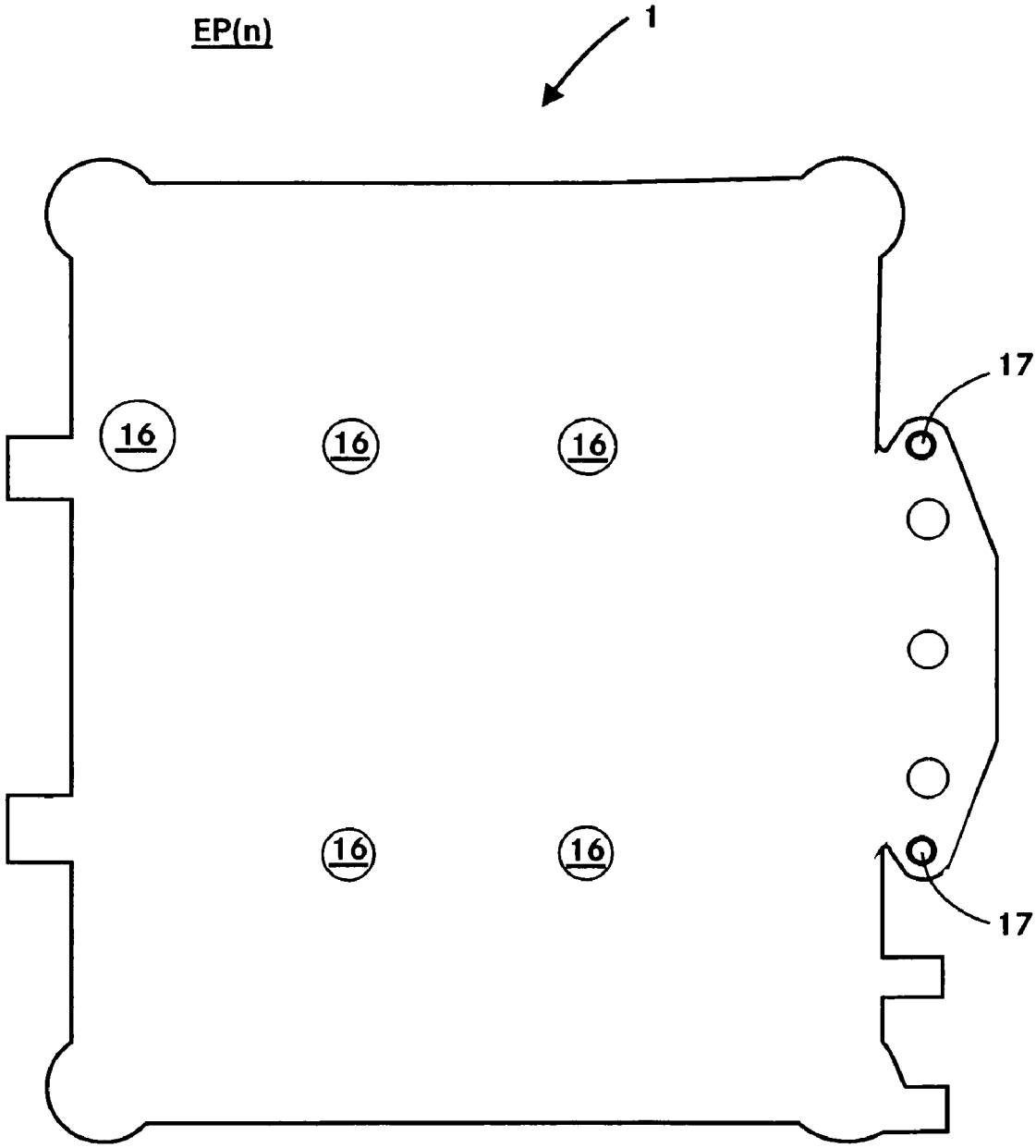
FIG. 5 shows a further individual plate.

FIG. 5 shows an individual plate EP(n) which is a cover plate disposed at the bottom to close the channels in the lowermost channel plate toward the ambient. In the individual plate EP(n), the bores by which the bottom plate is releasably connected to the crankcase 2 are indicated by the reference numeral 16. The reference numeral 17 marks a respective thread insert.

The invention as described herein has the following advantages:

The bottom plate structure permits an increased packing density.

A change in the position of for example a pump can be accommodated simply by an exchange of a respective individual plate.

In the bottom plate, additional functions such as the guided flow of fuel, cooling and preheating can be integrated in a simple manner.

Casting openings are not present so that such openings do not need to be plugged as it is necessary for a cast bottom plate.

The manufacture of the individual plates requires minimal tooling expenses.

The joining techniques for the individual plates, i.e. cementing or soldering are well tested.

What is claimed is:

1. A crankcase bottom plate (1) for an internal combustion engine, said bottom plate (1) being disposed at the bottom of an engine crankcase and having channels for lubricants and coolants, and comprising a number of individual plates (EP(i)) of the same circumferential shape, said individual plates (EP(i)) including at least one inner individual plate tightly sandwiched between opposite outer individual plates, with sections cut out of the inner individual plate (EP(i)) to form between the outer plates in the inner individual plate said channels for conducting the lubricants and the coolants through the interior of the crankcase bottom plate (1) which is formed solely by the tightly joined sandwiched inner and outer plates.

2. A bottom plate according to claim 1, wherein the individual plates (EP(i)) have all the same thickness.

3. A bottom plate according to claim 1, wherein the individual plates (EP(i)) have different thicknesses.

4. A bottom plate according to claim 1, wherein the bottom plate (1) includes, cut into the various individual plates (EP(i)), also passages for conducting fuel, for providing preheating, drainage and venting.

5. A bottom plate according to claim 1, wherein one of said individual plates (EP(0)) is provided, at least opposite one of the crankcase (2) and the ambience with a fluid guide structure (18).

6. A bottom plate according to claim 1, wherein the individual sandwiched plates (EP(i)) are joined by one of cementing and soldering.

* * * * *